US005916416A

United States Patent [19]

Fedrigoni et al.

[11] Patent Number: 5,916,416

[45] Date of Patent: Jun. 29, 1999

[54] METHOD AND APPARATUS FOR MANUFACTURING PAPERS WITH WATERMARKS OR PATTERNS AND PAPER THUS MANUFACTURED

[75] Inventors: Giuseppe Fedrigoni, Verona; Alberto De Luca, Riva del Garda, both of Italy

[73] Assignee: Cartiere Fedrigoni & C. S.p.A., Arco, Italy

[21] Appl. No.: 08/854,729

[22] Filed: May 12, 1997

[30] Foreign Application Priority Data

May 15, 1996 [IT] Italy ..... VR96A0048

[51] Int. Cl.[6] ..... D21F 1/44; D21F 1/42

[52] U.S. Cl. ..... 162/109; 162/134; 162/126; 162/186; 162/162

[58] Field of Search ..... 162/134, 110, 162/109, 266, 265, 298, 184, 300, 315, 116, 126, 128, 186

[56] References Cited

FOREIGN PATENT DOCUMENTS 0 580 363 1/1994 European Pat. Off. .

2 187 419 9/1987 United Kingdom .

*Primary Examiner*—Peter Chin
*Assistant Examiner*—Kevin Cronin
*Attorney, Agent, or Firm*—Guido Modiano; Albert Josif

[57] ABSTRACT

A method for producing watermarks or patterns in paper and cardboard which can be performed during a process for manufacturing the paper or cardboard comprises the following steps: preparing a primary fibrous mix of cotton cellulose based on alpha-cellulose with the addition of sulfate cellulose; preparing a secondary fibrous mix which has substantially the same composition as the primary mix but to which an adapted dye and/or pigment has been added; spreading the resulting fluid mix on a moving formation board of a paper manufacturing plant, so as to obtain a layer of very moist cellulose pulp designed to be dehumidified and stabilized along a preset path on the formation table; applying a jet or jets of secondary fibrous mix to the relatively fluid layer of primary fibrous mix so as to produce a recess as a consequence of the lateral displacement, with respect to each jet, occurring in the layer of primary fibrous mix, the recess being filled with the secondary fibrous mix by the respective jet; and amalgamating the material of the applied secondary mix so as to form a uniform agglomarate with the material of the primary mix.

8 Claims, 8 Drawing Sheets

METHOD AND APPARATUS FOR MANUFACTURING PAPERS WITH WATERMARKS OR PATTERNS AND PAPER THUS MANUFACTURED

BACKGROUND OF THE INVENTION

The present invention relates to a method and an apparatus for manufacturing paper and cardboard having watermarks or patterns and to the paper and cardboard thus obtained.

SUMMARY OF THE INVENTION

A first object of the present invention is to provide a method for manufacturing papers and cardboards which makes it possible to produce a plurality of patterns or watermarks during paper manufacture without the need of interrupting the manufacturing process, thus avoiding downtimes caused by machine stops.

An object of the present invention is to provide an apparatus for producing watermarks or patterns in the paper being manufactured which can be applied on the conventional formation table or tape of a paper manufacturing plant of any suitable type.

Another object of the present invention is to provide papers and cardboard watermarks or patterns obtained without using a conventional dandy roll.

A further object of the present invention is to make it possible to obtain papers or cardboards provided with security watermarks, i.e., watermarks which can be made visible only by adding chemicals which react with adapted markers.

According to a first aspect of the present invention, there is provided a method for producing watermarks or patterns in paper and cardboard which can be obtained during a process for manufacturing paper or cardboard, said method comprising the following steps:

preparing a primary fibrous mix of cotton cellulose with a high content of alpha-cellulose to which sulfate cellulose has been added;

spreading the fluid mix thus obtained on a moving formation table of a paper manufacturing plant, so as to obtain a layer of very moist cellulose pulp designed to be dehumidified and stabilized along a preset path on the said formation table;

and is characterized in that it comprises:

preparation of a secondary fibrous mix which substantially has the same composition as said primary fibrous mix to which a suitable dye and/or pigment has been added;

application, in the form of at least one jet of said secondary fibrous mix to said relatively fluid layer of pulp obtained from the primary fibrous mix, said at least one jet being directed so as to produce a recess as a consequence of the lateral displacement with respect to the jet, which occurs in the layer of primary fibrous mix, said recess being filled with the dyed or pigmented fibrous mix applied by said at least one jet and amalgamation of the material of the applied secondary mix so as to form a uniform body together with the material of the primary mix.

Advantageously, the jet can be continuous or intermittent, according to a preset sequence which depends on the pattern or watermark to be obtained in the paper or cardboard.

According to another aspect of the present invention, there is provided an apparatus for carrying out the above-described method for manufacturing watermarks or patterns in paper or cardboard while being formed on a formation table or tape of a paper- or cardboard manufacturing plant, which is characterized in that it comprises:

at least one manifold, which can be located proximate to the formation table;

at least one jet nozzle, which can be fed by at least one manifold and is arranged above said formation table or tape so that it can be angularly adjusted with respect thereto;

a feeding duct for secondary fibrous mix and a return duct from the or each manifold; and a source of secondary fibrous mix arranged to supply the feed duct and to receive the material discharged from the return duct of said at least one manifold.

Advantageously, said source of cellulose mix comprises a feeder reservoir provided with an agitator, a delivery pump, and a filtration system, for feeding dyed and/or pigmented mix to the or each feed duct, a reservoir for storing the cellulose mix provided with a pump delivering to the feeder reservoir and with a level measuring device, and a dye or pigment reservoir arranged to feed the storage reservoir in a controlled manner.

According to a further aspect of the present invention, there is provided a paper or cardboard which has dyed or pigmented watermarks formed by adding dyed and/or pigmented pulp-like material which has the same composition as the paper or cardboard.

BRIEF DESCRIPTION OF THE DRAWINGS

Further aspects and advantages of the method according to the present invention will become apparent from the following detailed description of some embodiments thereof, given only by way of non-limitative examples.

EXAMPLE 1

Figure 1:
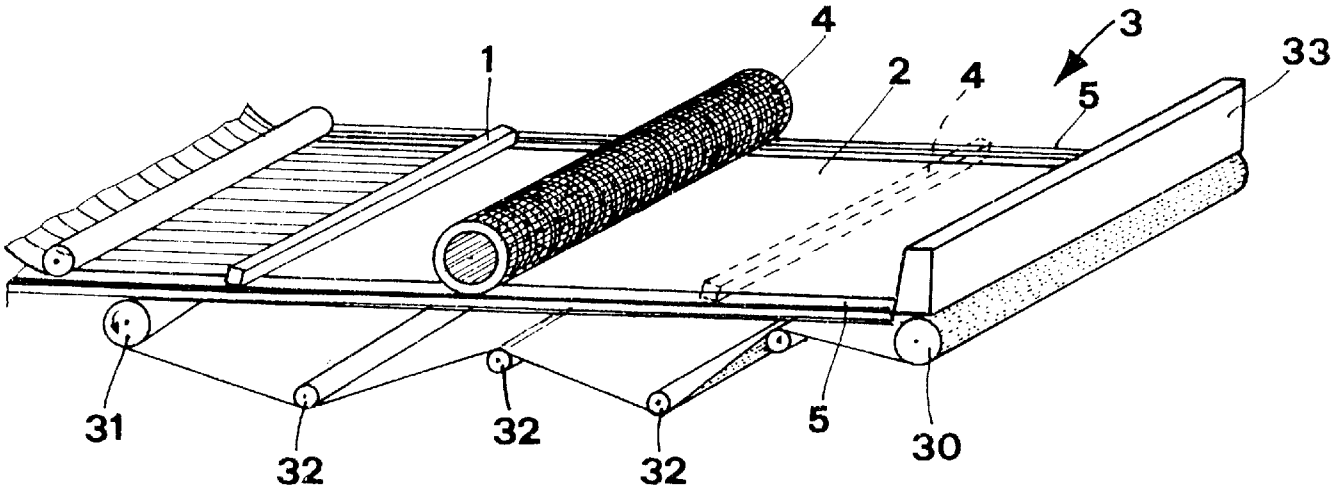

A primary fibrous mix was prepared which had softness and good rigidity characteristics and had the following composition:

| | |
|---|---|
| cotton cellulose designed to give softness to the final product | 8.5% |
| mechanical wood pulp, adapted to give a fluffy effect to the final product | 27.0% |
| sulfate cellulose, adapted to give mechanical strength to the final product | 64.5% |
| Total | 100.0% |

This mix was spread on a formation table or tape of a conventional paper-manufacturing plant and was treated with an apparatus (described in detail hereinafter) with a plurality of jets of a mix having the same composition as that specified above, but pigmented with light dye.

The result was a dark gray paper affected by parallel lines approximately 1.2–1.3 mm wide which were significantly lighter in colour and integral with the paper body and suitable for giving a "pinstripe" appearance to the paper. The impact force of the jets in fact produced a continuous groove-shaped recess or hollow between the surface fibers of the body or base paper layer being formed, and a simultaneous application of secondary fibrous mix (as also specified hereinafter), i.e. dyed pulp-like material having the same composition as the base paper layer, which results in the filling of the grooved recess.

Since the base paper layer which advances on the tape is still relatively fluid, the formation of a groove simply causes fibers to move apart and to amalgamate and level out in the pulp-like layer immediately thereafter, thereby also acting as confinement sides or barriers for the applied material supplied by the jet.

EXAMPLE 2

The same procedure as in Example 1 was followed, but with a primary fibrous mix having the following composition:

| | |
|---|---|
| cotton cellulose | 15% |
| mechanical wood pulp | 16% |
| sulfate cellulose | 69% |
| Total | 100% |

The result was a rather resistant pinstripe paper with deep blue linear dashes. The linear dashes were obtained by rhythmically interrupting the jets of blue-dyed cellulose mix at a preset rate.

EXAMPLE 3

The same procedure as in Example 1 was followed, but using a primary fibrous mix having the following composition:

| | |
|---|---|
| cotton cellulose | 20% |
| mechanical wood pulp | 34% |
| sulfate cellulose | 46% |
| Total | 100% |

A relatively rigid pinstripe white paper with pale blue lines was obtained.

EXAMPLE 4

The same procedure as in Example 1 was followed, but using a primary fibrous mix having the following composition:

| | |
|---|---|
| cotton cellulose | 6% |
| mechanical wood pulp | 16% |
| sulfate cellulose | 78% |
| Total | 100% |

The result was a red paper affected by wave-shaped white lines obtained by causing the jets of fibrous mix to wave.

An average of the physical and mechanical characteristics of papers obtained according to the above Examples 1 to 4 is given in the following Table 1, which also indicates maximum and minimum tolerances.

TABLE 1

| | Unit of measure | Nominal value | Tolerances min. | Tolerances max. | Type of analysis |
|---|---|---|---|---|---|
| Grammage | g/sq.m | 100 | 98 | 102 | primary |
| Thickness | micron | 160 | 150 | 170 | secondary |
| Absolute humidity | % | 50 | 45 | 55 | primary |
| Gurley air res. | sec. | 30 | 15 | 50 | secondary |

TABLE 1-continued

| | Unit of measure | Nominal value | Tolerances min. | Tolerances max. | Type of analysis |
|---|---|---|---|---|---|
| Cobb index (felt) | g/sq.m | 25 | 20 | 30 | primary |
| Bursting strength | KPa | 200 | 180 | > | secondary |
| Tearing strength | | | | | |
| longitudinal | mN | 700 | 500 | 900 | secondary |
| transverse | mN | 700 | 500 | 900 | secondary |
| Dry pulling strength | | | | | |
| longitudinal | N/15 mm | 60 | 50 | > | secondary |
| transverse | N/15 mm | 32 | 28 | > | secondary |
| Dry pulling strength | | | | | |
| longitudinal | % | 2.0 | 1.8 | > | secondary |
| transverse | % | 4.0 | 3.0 | > | secondary |
| Folding strength | | | | | |
| longitudinal | no. | 40 | 30 | 60 | secondary |
| transverse | no. | 30 | 20 | 50 | secondary |
| Taber rigidity | | | | | |
| longitudinal | U.T. | 2.3 | 2.0 | > | secondary |
| transverse | U.T. | 2.0 | 1.5 | > | secondary |

The cotton cellulose used in the above Examples has a high content of alpha-cellulose designed to give the paper a soft touch which can be similar to the touch of fabric, whilst the mechanical wood pulp helps to give "fluffy" visual characteristics to the final paper.

Examples of composition of the secondary fibrous mix to be added by jet to a sheet of paper being formed in order to produce immediate monolithic composition are given hereafter.

EXAMPLE A

To obtain a pinstripe effect of the final paper, with bluish lines at average viscosity for a finished paper grammage between 80 and 120 g/sq m, with a white color, the following composition was used for the secondary fibrous mix:

| | % | weight in grams |
|---|---|---|
| Cellulose fiber, in the same proportion and with the same composition as in the primary mix | 2.2 | 22 |
| Inorganic pigment | 1.6 | 16 |
| Surfactants | 0.000016 | 0.00016 |
| Direct blue dye | 0.006 | 0.06 |
| Antifoaming agent | 0.0001 | 0.001 |
| Water | 96.193884 | 961.93884 |
| Total | 100 | 1000 |

EXAMPLE B

The same procedure as in Example A was followed to obtain a pinstripe effect with bright red lines with high viscosity for a finished paper grammage between 130 and 250 g/sq.m in a plurality of colors (green, yellow, blue) by using the following composition for the secondary mix:

| | % | weight in grams |
|---|---|---|
| Cellulose fiber, in the same proportion and with the same composition as in the primary mix | 3.7 | 37 |

-continued

| | % | weight in grams |
|---|---|---|
| Inorganic pigment | 2.2 | 22 |
| Surfactants | 0.000018 | 0.00018 |
| Dye | 0.12 | 1.2 |
| Antifoaming agent | 0.00014 | 0.0014 |
| Water | 93.979842 | 939.79842 |
| Total | 100 | 1000 |

EXAMPLE C

The same procedure as in Example A was followed in order to obtain a pinstripe effect with Lemon yellow lines with very high viscosity for a finished paper grammage between 260 and 700 g/sq.m in a plurality of colors (black, blue, green, brown, red) by using the following composition for the secondary mix:

| | % | weight in grams |
|---|---|---|
| Cellulose fiber, in the same proportion and with the same composition as in the primary mix | 5.5 | 55 |
| Inorganic pigment | 4.2 | 42 |
| Surfactants | 0.000011 | 0.00011 |
| Dye | 0.023 | 0.23 |
| Antifoaming agent | 0 | 0 |
| Water | 93.276989 | 902.76989 |
| Total | 100 | 1000 |

All the dyes used in Examples A to C for calorimetric differentiation of the watermark lines are inclined in the light solidity scale which equals the oxidation rate of the cellulose fiber forming the sheet of paper.

Viscosity at 20° C. ranges between 30 and 100 mPa.s by the Brookfield SP no. 3 test and can be chemically anionic and cationic in nature with a pH ranging between 5 and 9.

If desired, it is possible to use a fluorescent dye or a dye which can be detected with a UV system at wavelengths between 50 and 400 nm in the visible part of the spectrum.

A detailed description is given hereafter, with reference to the drawings, of an embodiment of a multiple-jet apparatus used to obtain a paper featuring watermarks, security watermarks or patterns without using the conventional dandy roll.

Figure 8:
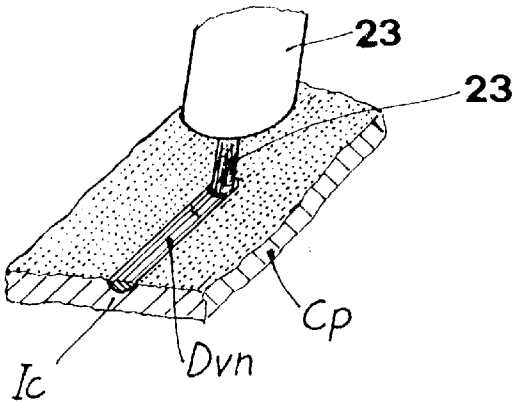
Figure 2:
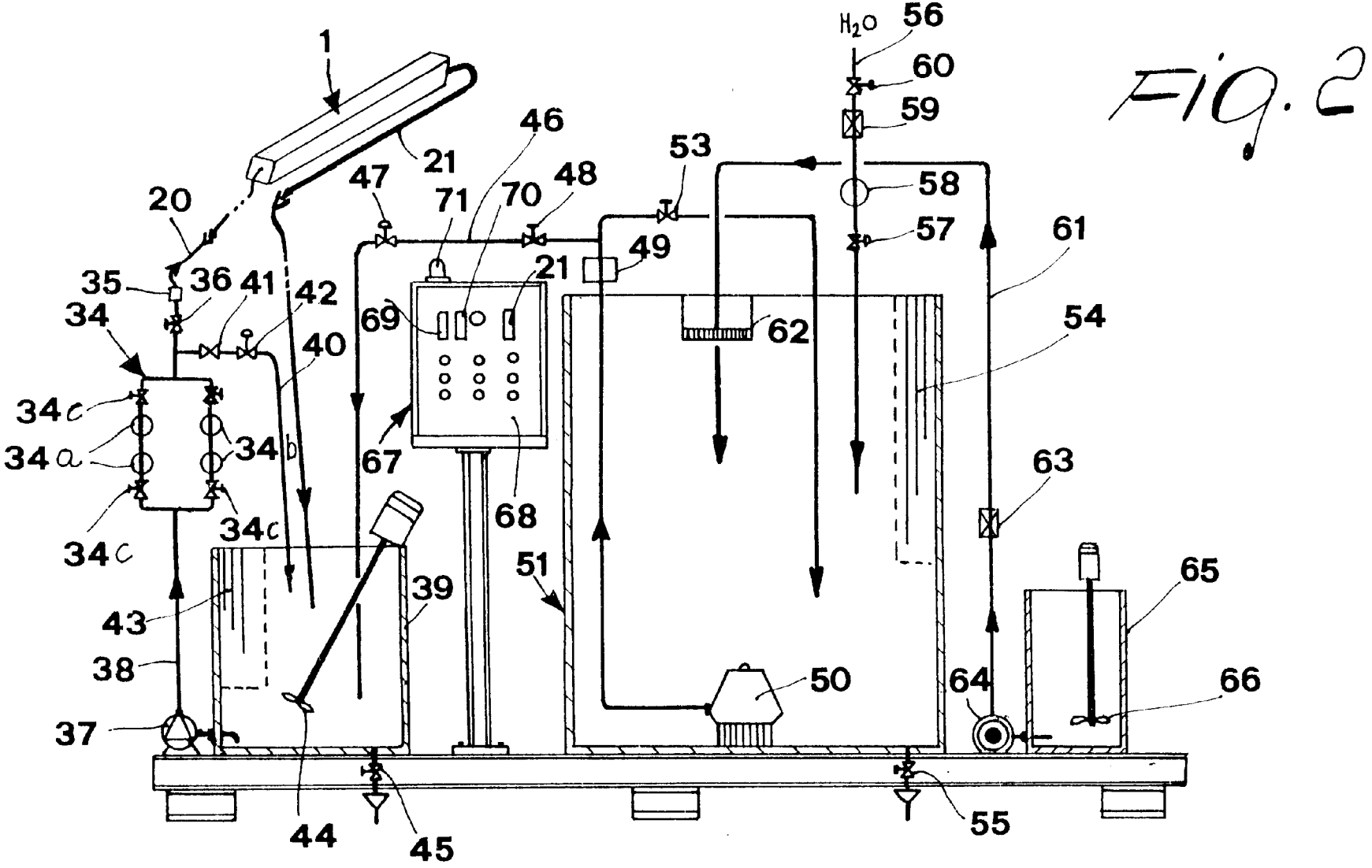
Figure 3:
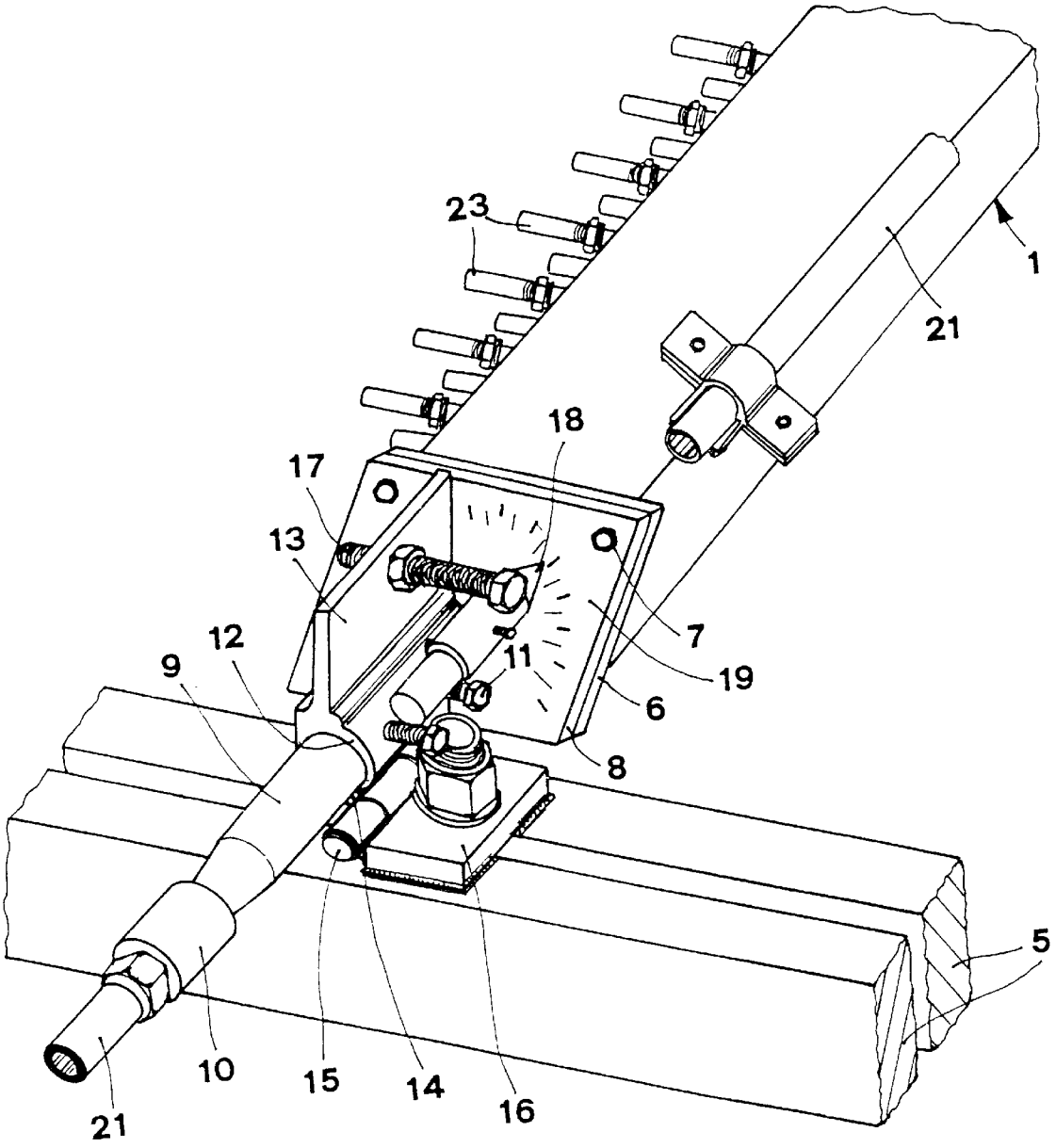
Figure 4:
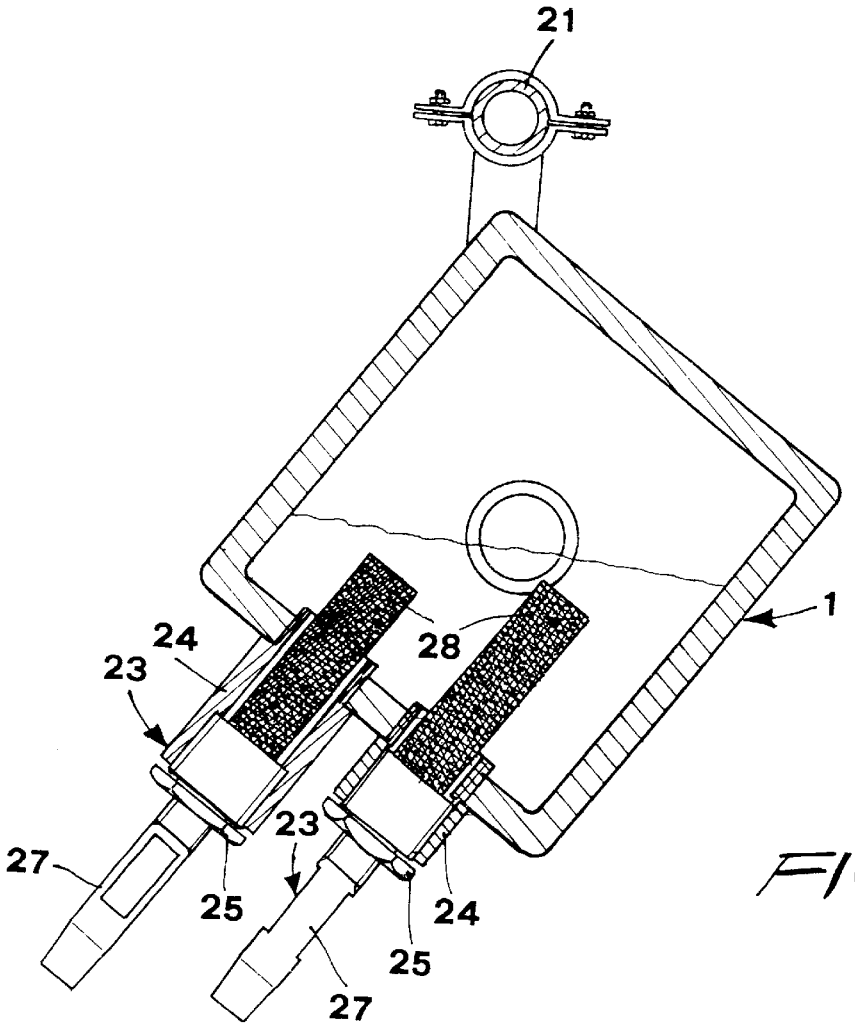
Figure 5:
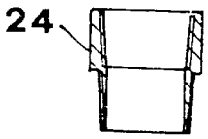
Figure 6:
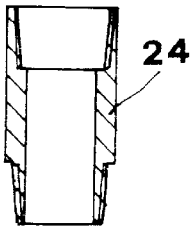
Figure 7:
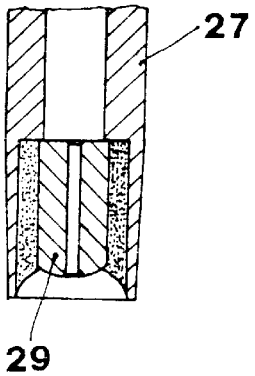
Figure 9:
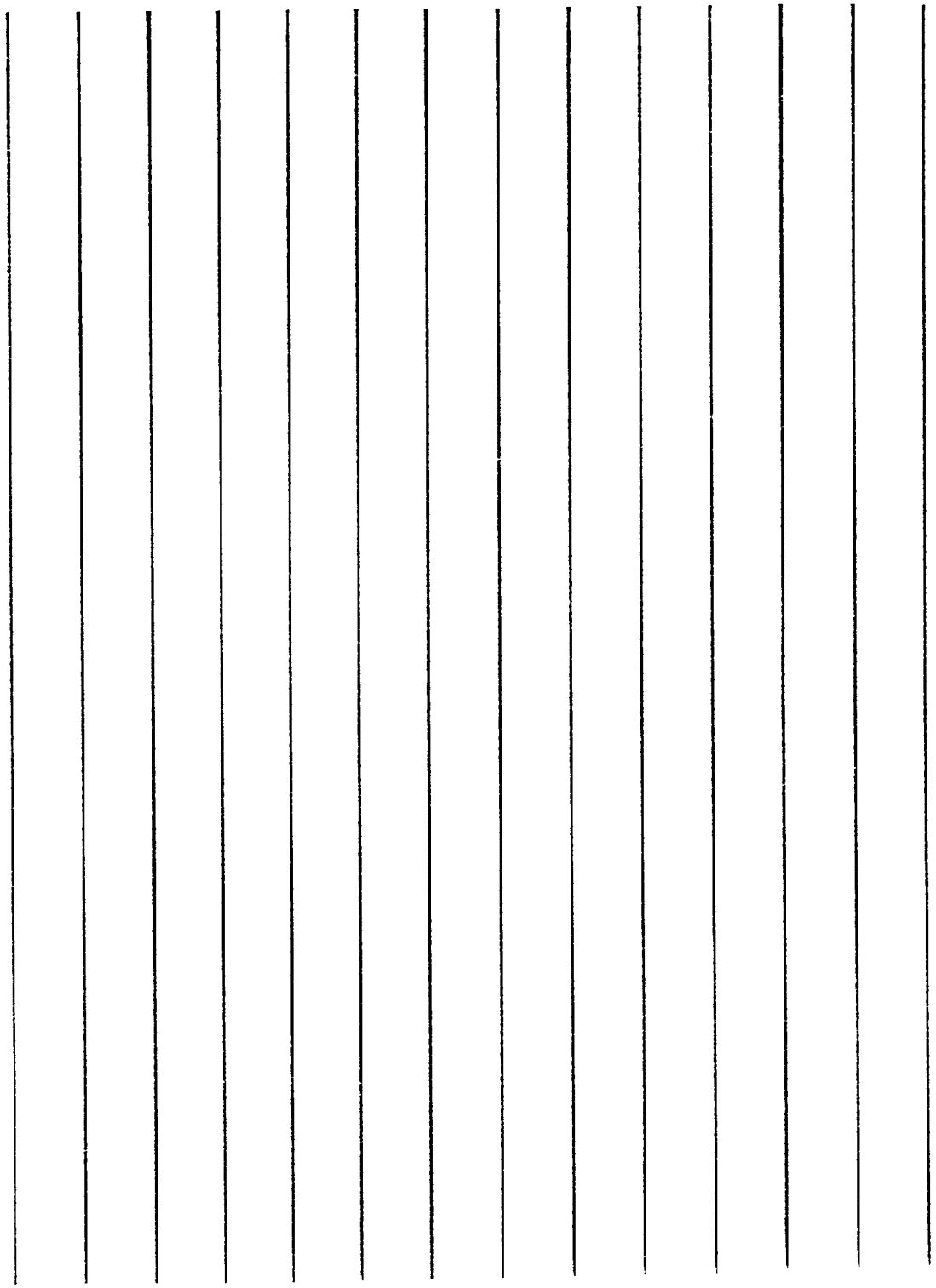
Figure 10:
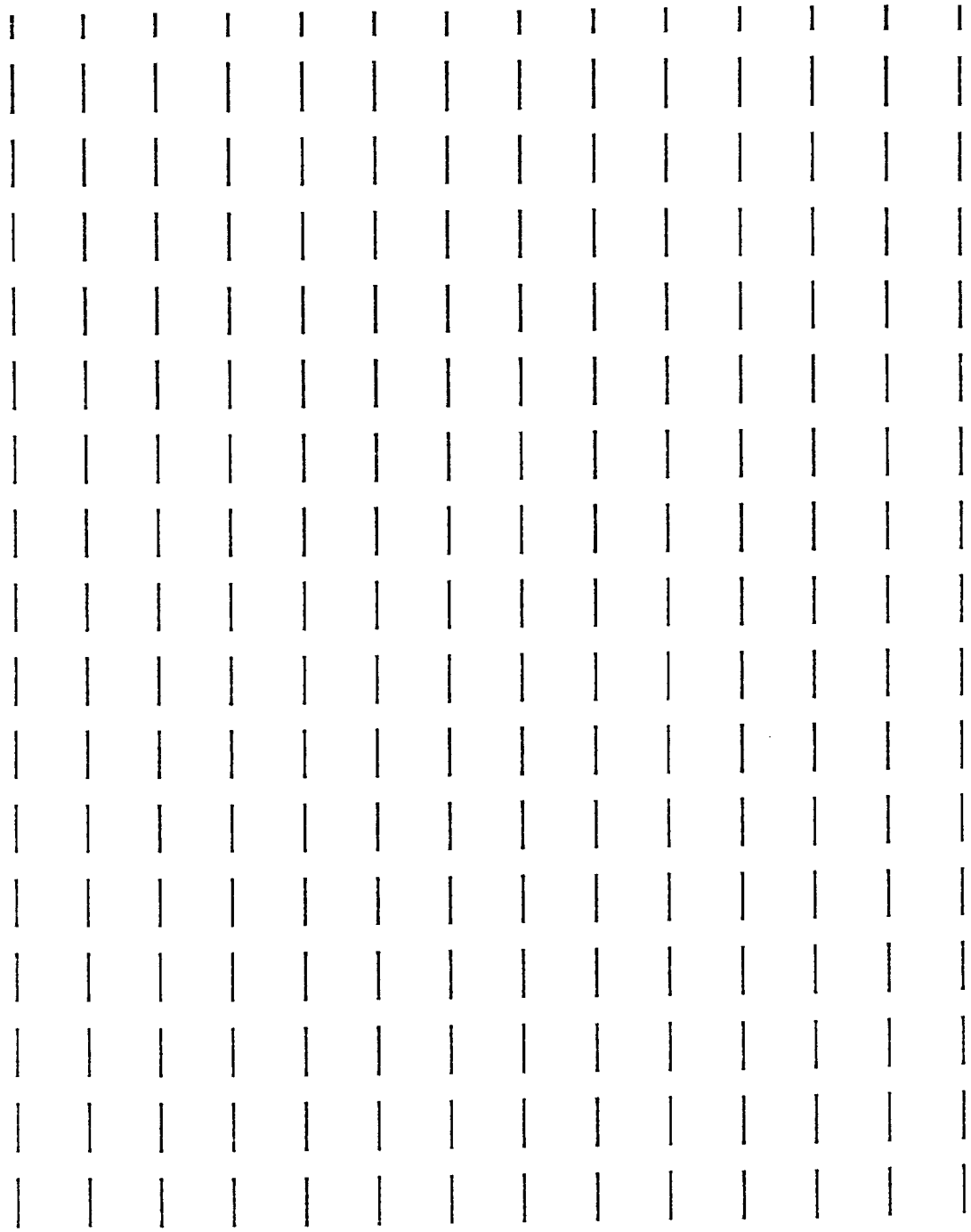
Figure 11:
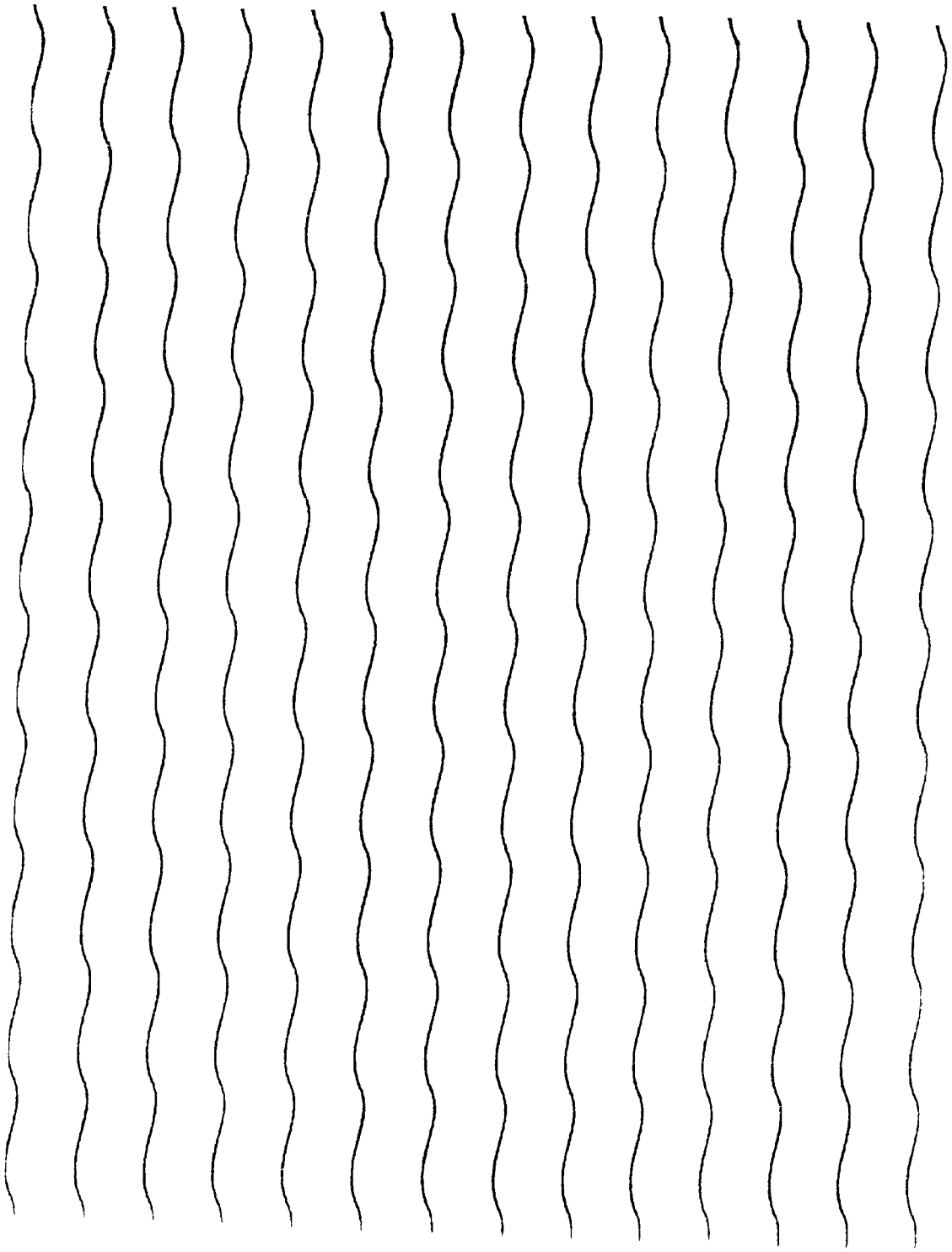
Figure 12:
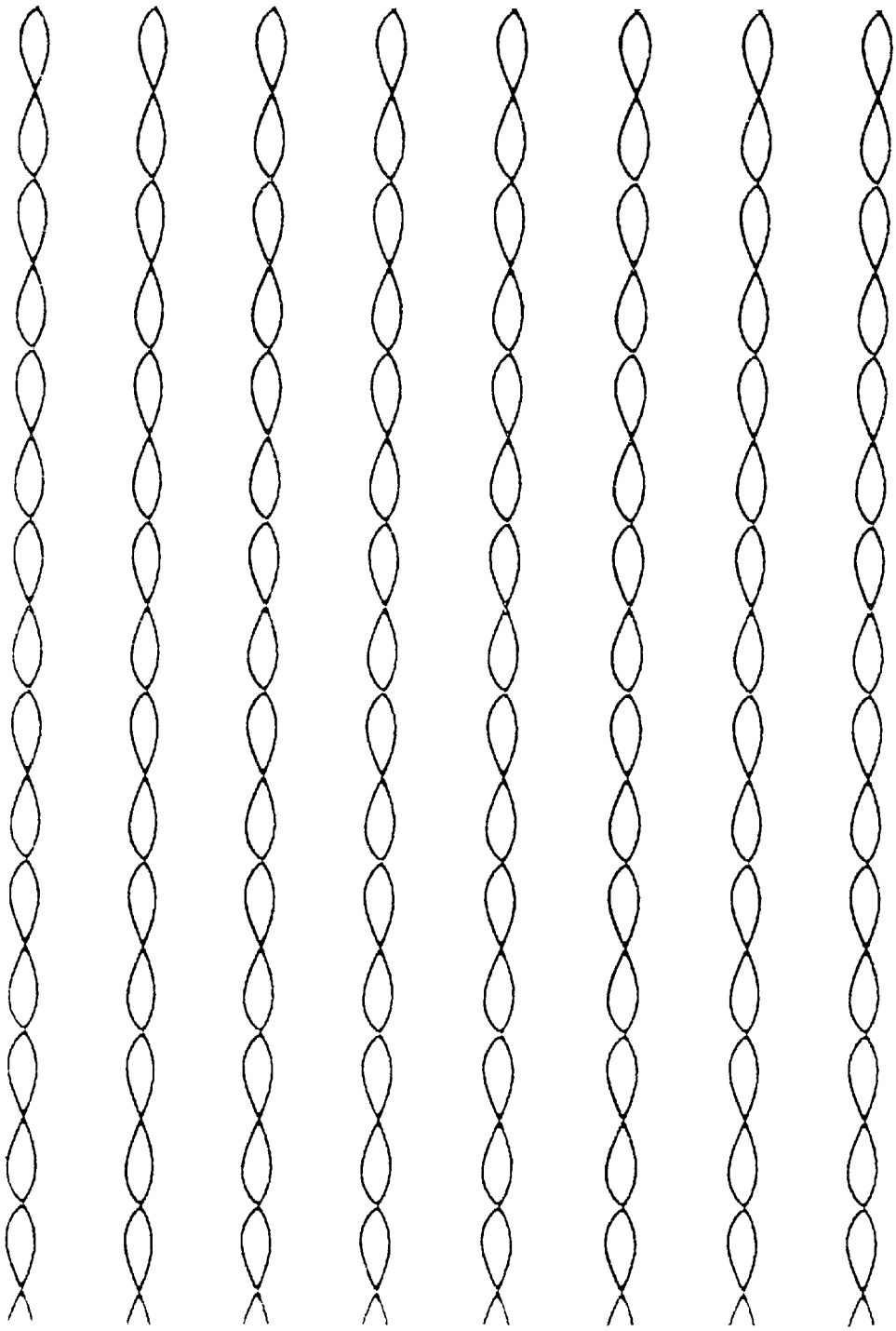

In the drawings:

FIG. 1 is a schematic perspective view of a formation table, provided with a tape of a paper-manufacturing plant provided with a multiple-jet apparatus according to the present invention;

FIG. 2 is a schematic lateral elevation view, with parts shown in cross-section, illustrating the operation of an apparatus according to the present invention;

FIG. 3 is a partial perspective view of a nozzle-supporting manifold mounted so that it can be orientated astride the formation table or tape of FIG. 1;

FIG. 4 is an enlarged-scale transverse sectional view of the nozzle-supporting manifold of FIG. 3;

FIGS. 5 and 6 are views of two nozzle-supporting spacers of different lengths for the manifold of FIGS. 3 and 4;

FIG. 7 is a partial axial longitudinal sectional view of a nozzle fitted in a respective spacer;

FIG. 8 is a schematic perspective view of a groove formed by a jet of applied secondary mix material which binds and amalgamates, so as to become fully included in an underlying ribbon of paper lying on the formation table or tape; and FIGS. 9 to 12 are views of patterns obtained on paper produced according to the method of the present invention.

In the accompanying drawings, identical or similar parts or components have been designated by the same reference numerals.

DESCRIPTION OF THE PREFERRED EMBODIMENTS

With reference to the Figures in the drawings, it will be seen that an apparatus for manufacturing watermarks or patterns in paper or cardboard while being manufactured is constituted by one or more manifolds 1 which can be arranged transversely above a formation table or tape 2 of a paper or cardboard-manufacturing apparatus, generally designated by the reference numeral 3 (FIG. 1). Preferably, the manifold 1 is arranged downstream of a conventional dandy roll 4 with respect to the advancement direction of the formation tape 2, indicated by the arrow A, but it might also be placed upstream of the dandy roll 4, or it is possible to provide one manifold upstream and one downstream of said dandy roll, according to requirements.

The at least one manifold 1, as better shown in FIG. 3, is supported so as to straddle two lateral longitudinal members 5 extending along the sides of the formation table or tape 2 so that the manifold can rotate about its own longitudinal axis. More particularly, the manifold 4 has two end flanges 6, to each of which a flange 8 is fixed, e.g. by means of bolts 7, to the end of a respective portion of rigid pipe 9, whose other end is provided with a coupling or nipple 10. Each portion of the pipe 9 is in turn inserted and fixed, by means of locking grub screws or headed screws 11, in a sleeve 12 having two wings 13 and 14 opposite to each other. The wing 14 is linked to an articulation pivot 15 supported by a fixing block 16 integral with the longitudinal members 5, whilst the wing 13 is formed with a threaded through hole into which an adjustment screw 17 can be screwed to make it possible to adjust the distance at which it must stop with respect to the longitudinal members 5 when the entire rotating assembly formed by the sleeve 12 and by the portion of pipe and thus by the flanges 6 and 7 and the manifold 1 is rotated about the pair of aligned pivots 15.

If desired, the support 16 or some other fixed part can support a pointer 18 pointed towards the flange 8, on which a dividing scale in angular degrees 19 is suitably provided or otherwise applied for reading the values of the angular displacements of the moving assembly from a reference position.

The couplings 10 of the portions of pipe 9 can be connected to a respective flexible hose 20 and 21; the hose 20 acts as feeding hose for the manifold, whilst the hose 21 acts as discharge hose. If the hose 21 is made of a flexible plastic material, in use, it can advantageously also act as a damping element for pulsations occurring inside the manifold 1 above the level of the liquid mix contained therein.

The manifold 1 is constituted by a tubular body having an internal opening having a four-sided cross-section. One of its side walls supports a plurality of jet nozzles 23, which are arranged for example in a staggered configuration along two parallel longitudinal rows or lines. Each nozzle 23 is constituted by a supporting ring 24, a threaded connector 25, an internal filter 26, and a nozzle tip 27 supported by the threaded connector.

The internal opening of the manifold 1 having a four-sided cross-section is more advantageous than a round cross-section for fluid-dynamics reasons, since it ensures a more uniform size and distribution of the threads of the fluid mix directed towards the respective nozzles 23 distributed along said manifold.

The supporting ring 24 is longer for the nozzles of the upper row and shorter for those of the lower row, so that, in use, the tips of the nozzles of both rows are substantially at the same level, albeit staggered, above the underlying paper or cardboard web being formed on the formation tape 2 (FIG. 4). Moreover, each ring 24 has an externally threaded end designed to be screwed into a corresponding threaded through hole in the wall of the manifold and to at least partially accommodate a filter 28; the other end of each ring 24 is internally threaded for receiving therein a threaded connector 25 to fix a respective nozzle tip 27. Said nozzle tip can be internally provided, at its end, with a gauged nozzle 29 made of tough material, typically a ceramic material (FIG. 7).

Once the nozzles 23 have been placed above the formation tape 2, by turning the sleeves 12 about the pivots 15, by screwing the adjustment screw 17 in one direction or the other, it is possible to vary the angle of incidence of the nozzles 23 with respect to the plane in which the formation tape 2 is arranged.

Said tape is provided underneath, as is conventional in the art, with suction boxes (not shown in the drawings) and is stretched by a rear free guiding roller 30 and suction driving roller 31, whilst its return portion follows a zigzag washing path guided by guiding rollers 32. A conventional head box 33 is located above the rear guiding roller 30 and spreads on the formation tape a substantially uniform web of primary paper mix which, as it is moved towards the driving roller 31, loses water mainly owing to the action of the suction boxes and gradually becomes a paper or cardboard web.

When passing under the manifold 1, the web is affected by jets of a secondary mix which is substantially of the same type as that of the mix of the paper being formed, but differently pigmented.

To this end, the supply duct 20 of the manifold 1 is connected to a filtering system 34 by means of a pressure sensor and a cutoff valve 36. The filtering system 34 is in turn connected via a duct 38 to the delivery of an electric pump 37, whose suction inlet is connected to the interior of a feeder reservoir 39 just above the bottom thereof.

Preferably, between the cutoff valve 36 and the filtering system 34 a shunt duct 40 is provided which starting from the duct 20 discharges into the feeder reservoir through a cutoff valve 41 and a pressure adjustment valve 42.

The filtering system 34 preferably comprises two filtering units 34*a* and 34*b*, which are connected in parallel and have interposed therebetween cutoff valves 34*c*. Uninterrupted filtration is thus ensured even when it is necessary to clean one filtering unit, since the other filtering unit can be held in operation.

The discharge or return duct 21 instead discharges directly into the feeder reservoir 39.

Said feeder reservoir is provided with sensors 43 for detecting the level of the dyed and/or pigmented liquid mix contained in the tank and is also equipped with a motorized agitator 44 and optionally with a discharge cock 45.

A pipe 46 also discharges into the feeder reservoir 39 and is provided with an adjustment valve 47, driven by the level sensors 43, and with a cutoff valve 48, and is connected, across a viscosity meter 49, to the delivery of an electric pump 50 arranged on the bottom of a storage reservoir 51 for primary cellulose mix. Downstream of the viscosity meter 49, the pipe 46 is connected to a discharge pipe 52 inside the storage reservoir, with interposition of a cutoff valve 53. The storage reservoir 51 also has level detecting probes 54 and a discharge cock 55 on the bottom.

A water duct 56 and a duct 61 discharge into the storage reservoir 51; said duct 56 is provided with an electric valve 57, driven by the probes 54, for maintaining a preset level within the storage reservoir, with a filter 58, with a liter counter 59 and with a cutoff valve 60, and the duct 61 is provided with a filter 62 and a liter counter 63 and is connected to the delivery of an electric pump 64. The intake port of said pump is connected to the inside of a reservoir 65 for the dye or pigment designed to be fed in a controlled manner to the storage reservoir 51. The dye or pigment reservoir 65 is provided with an agitator 66.

The entire feeder system of the manifold 1 is controlled by a control unit, shown schematically and generally designated by the reference numeral 67 in FIG. 2, which has an electrical control panel provided with a pressure regulator 69, a viscosity control regulator, a general control PLC, and a luminous revolving alarm 71.

A load of cellulose mix having the same composition as that fed to the head box 33 at the leading edge of the formation tape 2 is maintained in the storage reservoir 51 (for example by means of an adapted feeder duct, not illustrated in the drawings). The dispersion of the components and additives must reach a level which ensures that no clots are formed. For this purpose, agitation and mix transfer from one reservoir to the other must be performed gently, so as to avoid formation of foam.

The temperature of the mix must be kept strictly within a range between 15 and 85° C. and preferably between 10° C. above or below the paper-like medium temperature in order to constantly maintain the correct viscosity for impact with the paper medium on the formation tape 2, so as to ensure that the material added by jet-spraying through the nozzles 23 binds almost immediately to it, so as to become amalgamated therewith.

In order to do this, the material leaving the nozzles 23 must have a correct jet pressure, between 10 and 1000 cm of water head, preferably between 25 and 35 cm of water head, a specific vacuum interval in the suction box or boxes directly below the manifold 1, preferably in the range between 100 and 400 millibars, and a preset angle of incidence between the jets from the nozzles 23 and the web of paper lying on the formation tape 2. It has been found that in practise such an angle can be between 0 and 90° and preferably between 25° and 350°.

With the above-described apparatus it is thus possible to obtain watermarks or patterns, for example as shown in FIGS. 9 to 12, which illustrate merely by way of example papers with a so-called "pinstripe" effect obtained with the method and apparatus according to the present invention.

By arranging the manifold downstream of the dandy roll 4, as shown in FIG. 1, one obtains sharply outlined patterns or watermarks DVn within the margins of the deformation or hollow I*c* (FIG. 8) formed in the layer of primary mix paper C*p* by the jet or jets 23*a* from the nozzles 23, whilst by arranging the manifold upstream, where the layer or web of primary mix paper is more liquid, one obtains patterns or watermarks which are less sharply outlined and have less defined outlines.

It will be noted that in any case the patterns and the watermarks are obtained online, i.e., during manufacture of the paper, without having to interrupt the manufacturing process, to the full benefit of the productivity per unit time of the apparatus.

The above-described apparatus is susceptible to numerous modifications and variations within the scope of its protection defined by the claims.

Thus, for example, the manifolds 1 can feed a plurality of nozzles 23, which are mounted on a supporting structure separate from the manifold and arranged so as to straddle the formation tape 2 and are connected to the manifold by means of a respective duct which is for example flexible to allow various angular configurations of the structure and therefore of the nozzles with respect to the plane containing the formation tape. In this case, the manifold or manifolds 1 can also be fitted to the side of the formation tape.

The manifold 1, or in any case the nozzle supporting structure, can be mounted so that it can move along a transverse axis with respect to the direction of advancement of the formation tape and can be driven so as to perform a back-and-forth motion, for example to obtain particular wavy patterns or laid lines on the paper or cardboard being formed.

Moreover, instead of a single manifold 1 it is possible to use two or more manifolds 1 arranged in sequence above the formation tape 2, each manifold being optionally provided with one or two rows of nozzles 23 and contributing to the formation of specific patterns or laid lines on or in the underlying layer of primary mix paper, as will be apparent to an expert in the field.

What is claimed is:

1. A method for producing watermarks or patterns in paper and cardboard, which can be obtained during a process for manufacturing paper or cardboard, the method comprising the steps of:

preparing a primary fibrous mix of cotton cellulose with a high content of alpha-cellulose to which sulfate cellulose has been added;

spreading the fluid mix thus obtained on a moving formation table of a paper manufacturing plant, so as to obtain a layer of very moist cellulose pulp designed to be dehumidified and stabilized along a preset path on said formation table;

and further comprising:

preparing a secondary fibrous mix which substantially has the same composition as said primary fibrous mix but to which a suitable dye and/or pigment has been added;

applying, in the form of at least one jet, the secondary fibrous mix to said relatively fluid layer of pulp obtained from the primary fibrous mix, the at least one jet being directed so as to produce a recess as a consequence of a lateral displacement of material of the first layer, with respect to the jet, occurring in the layer of primary fibrous mix, only said recess being filled with the dyed or pigmented fibrous mix applied by said at least one jet; and amalgamating the material of the applied secondary mix so as to form a uniform body together with the material of the primary mix.

2. The method according to claim 1, wherein a plurality of jets are used, said jets being intermittent according to a preset sequence depending on the pattern or watermark to be formed in the paper or cardboard.

3. The method according to claim 1, wherein the temperature of the secondary fibrous mix which is fed to at least one manifold is in a range between 15° to 85° and, in order to ensure constant control over the impact viscosity of the secondary fibrous mix against the underlying layer of primary fibrous mix, the jet pressure is maintained between 10 and 1000 cm of water head, and the vacuum interval in the suction box or boxes directly below the nozzles is between 100 and 400 millibars.

4. The method according to claim 3, wherein the temperature of the secondary fibrous mix is ±10° C. of the temperature of the paper medium, the jet pressure is maintained between 25 and 35 cm of water head, and the vacuum interval is maintained between 200 and 250 millibar.

5. The method according to claim 3, wherein the viscosity of the secondary fibrous mix is kept between 30 and 100 mpa.s at an ambient temperature of approximately 20° C.

6. The method according to claim 1, wherein the angle of contact between the jets exiting from the nozzles and the paper web arranged on the formation screen is between 0 and 90°.

7. The method according to claim 6, wherein said angle of contact is between 25° and 35°.

8. A paper or cardboard with watermarks or patterns, obtained with the method of claim 1.

* * * * *